United States Patent [19]

Berdinner, Jr.

[11] 4,425,828

[45] Jan. 17, 1984

[54] RIGHT ANGLE DRIVE RATCHET SCREW-DRIVER

[76] Inventor: E. J. Berdinner, Jr., 2045 Meadow Dr., #1, Longmont, Colo. 80501

[21] Appl. No.: 325,639

[22] Filed: Nov. 30, 1981

[51] Int. Cl.[3] ..... B25B 13/46

[52] U.S. Cl. ..... 81/57.39

[58] Field of Search ..... 81/57.39, 57.46, 58.1

[56] References Cited

U.S. PATENT DOCUMENTS

| | | | |
|---|---|---|---|
| 2,058,855 | 10/1936 | Chapman | 81/63 |
| 2,507,681 | 5/1950 | Sage | 81/57.46 |
| 2,508,568 | 5/1950 | Ellison | 81/58.1 |
| 3,756,090 | 9/1973 | Mella et al. | 81/57.39 |
| 4,224,844 | 9/1980 | Henriksen | 81/58.1 |
| 4,346,630 | 8/1982 | Hanson | 81/57.39 |

*Primary Examiner*—James L. Jones, Jr.
*Attorney, Agent, or Firm*—Young & Martin

[57] ABSTRACT

A ratchet drive screw-driver includes a handle, a rotor journaled in one end of the handle with a screw-driver shank extending axially therefrom, a ratchet wheel and pawl mechanism for rotating the rotor, and an actuator mechanism for driving the ratchet. The actuator mechanism includes an elongated push rod positioned longitudinally in the handle and extending out the end of the handle perpendicular to the axis of rotation of the rotor. Reciprocating longitudinal motion of the push rod drives the ratchet mechanism and turns the rotor in either forward or reverse angular direction as desired. The ratchet mechanism can also be driven by swinging the handle about the axis of the rotor if desired.

6 Claims, 8 Drawing Figures

RIGHT ANGLE DRIVE RATCHET SCREW-DRIVER

BACKGROUND OF THE INVENTION

The present invention relates to ratchet screw-drivers and wrenches, and more particularly to a new and useful right angle drive for a ratchet screw-driver wherein longitudinal push-button activated motion drives a screw-driver angularly about an axis perpendicular to the longitudinal push button motion.

Conventional screw-drivers usually have an elongated shank with a flattened screw-driver on one end and a handle on the other end of the shank. Such conventional elongated shank screw-drivers have always been and probably will continue to be the most commonly used form of screw-driver device for turning screws. However, in many applications screws are positioned in structures in such a manner that the screw heads are inaccessible to conventional elongated shank type screw-drivers. For example, adjacent parts or components of a structure closely spaced over the screw head often make it impossible to turn the screw by use of a screw-driver with an elongated shank. Therefore, alternative screw-driver forms have been devised to gain access to such screws. For example, the ratchet screw-driver disclosed in U.S. Pat. No. 2,058,855, issued to J. Chapman, shows a ratchet handle screw-driver with a very short screw-driver shank. The screw-driver is driven by arcuate swinging motion of the handle about the axis of the screw-driver shank. The Chapman and similar devices are useful in applications wherein the space over the screw head might be limited, but they also require a wide ranging open space to the side of the screw to allow for sufficient arcuate swinging motion of the handle of the ratchet screw-driver. Where such space to the side of the screw is available, the Chapman type ratchet screw-drivers are useful. However, in many applications, there is both insufficient room over the top of the screw head for use of an elongated shank type screw-driver and insufficient room to the side of the screw head to allow sufficient swinging motion of a swinging handle type ratchet screw-driver. U.S. Pat. No. 2,406,149, issued to J. Jenni, discloses a right angle drive screw-driver with a reciprocating push-rod drive mechanism for use in such situations. However, the push-rod in the Jenni screw-driver must be rotated to disengage the rack and gear teeth drive mechanism after each push to pull the rod back out; otherwise, the screw-driver shank will be driven in a reverse direction. This drawback in the drive mechanism makes the use of the Jenni device somewhat cumbersome. It is also desirable in some circumstances to have the option of a quick reciprocating push button action to drive a screw while it is loose and to also be able to use the leverage of a swinging handle screw-driver to break loose or tighten screws.

SUMMARY OF THE INVENTION

Accordingly, it is an object of the present invention to provide a novel ratchet mechanism driven by reciprocal longitudinal motion to rotate a screw-driver shank about an axis that is perpendicular to the reciprocal longitudinal motion.

It is also an object of the present invention to provide a reciprocating push-button drive ratchet type screw-driver which is simple to operate with a minimum of motion in a confined space, but with the additional option of being able to use the leverage of swinging an elongated handle to break loose or tighten screws.

It is also an object of the present invention to provide a simple ratchet drive mechanism for a screw-driver which is particularly conducive to manufacturing with highly durable non-electrically conductive plastic materials for use on electronic equipment.

The right angle drive ratchet screw-driver of the present invention includes a short screw-driver shank connected to a rotor for imparting angular motion to a screw. The rotor is rotated with a ratchet drive mechansim adapted for converting longitudinal reciprocal motion of a push-rod to angular motion. The push-rod is positioned at a right angle to the axis of rotation of the screw-driver shank. The mounting of the push-rod and ratchet in the handle also allows the screw-driver to be driven by swinging the handle if desired. The ratchet mechanism is also reversible so that the screw can be driven in a reverse direction by the same reciprocating motion of the push-rod or swinging of the handle. The alternative embodiment of the ratchet mechanism is particularly conducive to manufacture of non-conductive plastic materials.

BRIEF DESCRIPTION OF THE DRAWINGS

Other objects, advantages and capabilities of the present invention will become more apparent as the description proceeds, taken in conjunction with the following drawings, in which.

DETAILED DESCRIPTION OF THE PREFERRED EMBODIMENT

Figure 1:
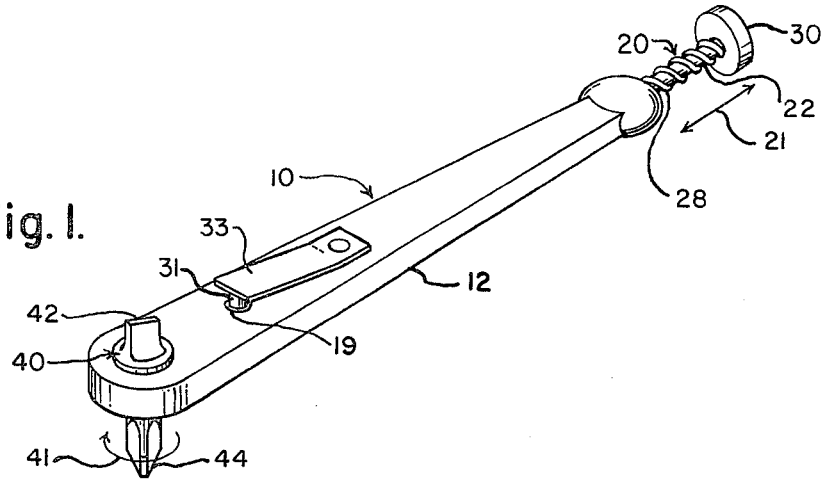
FIG. 1 is a perspective view of the right angle drive ratchet screw-driver of the present invention.
Figure 2:
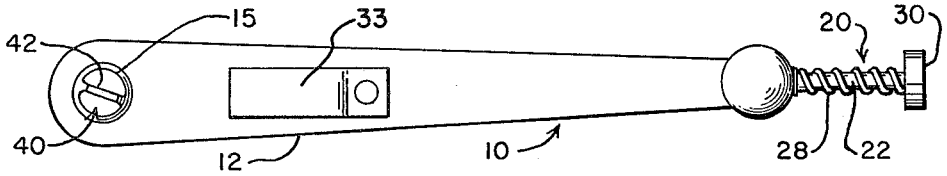
FIG. 2 is a top plan view of the ratchet screw-driver of the present invention.
Figure 3:
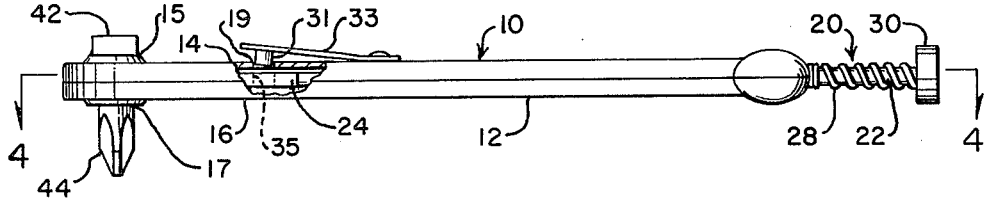
FIG. 3 is a side elevation view of the ratchet screw-driver of the present invention.

The right angle drive ratchet screw-driver 10 of the present invention is comprised primarily of a hollow elongated handle portion 12, a rotor 40, a conventional screw-driver form 42 extending axially outward from the rotor 40 in one direction, and a Phillips screw-driver shape 41 extending axially outward from the rotor 40 in the opposite direction. An actuator mechanism 20 includes a push-rod 22 extending outwardly of the rear or distal end of the handle portion 12. A push-button knob 30 is positioned on the distal end of the push-rod 22 to accomodate application of an axial force thereon by a person's thumb or finger, and a compression spring 28 is mounted on the push-rod shaft between the handle 12 and knob 30 for biasing the push-rod outwardly. Reciprocal motion of the push-button 30 and push-rod 22 in the longitudinal directions indicated by arrow 21 causes the screw-driver shank to be driven in the angular motion indicated by arrow 41 in FIGS. 1 and 4. The handle portion 12 is formed with a top casing 14 and a bottom casing 16 adapted for attachment together in a manner that forms a hollow interior in the handle 12.

Figure 4:
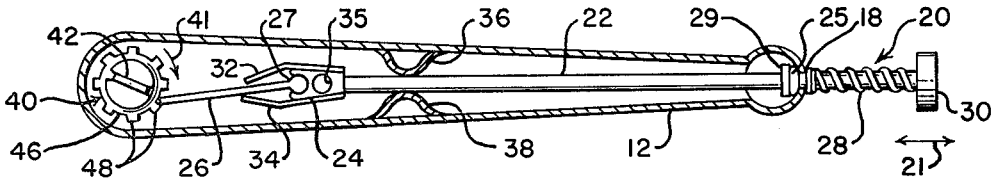
FIG. 4 is a cross-sectional view of the ratchet screw-driver of the present invention taken along lines 4—4 of FIG. 3.

The right angle ratchet drive mechanism of the preferred embodiment of the present invention is best seen in FIG. 4. The rotor 40 is positioned in the forward end of the handle 12 with its longitudinal axis perpendicular to the longitudinal axis of the handle 12. The midportion of the rotor 40 is in the form of a ratchet wheel 46 with a plurality of cogs 48 positioned around the peripheral surface of the ratchet wheel 46 in angular spaced apart relation to each other.

The push-rod 22 of the actuator mechanism 20 is slidably positioned longitudinally in the hollow handle 12 in such a manner that it can be reciprocated longitudinally in the direction of the arrow 21. An open ended swivel socket 24 is attached to the forward end of the push-rod 22 near the rotor 40. An elongated pawl 26 is positioned between the push-rod 22 and the rotor 40. The pawl 26 has a swivel end 27 adapted to fit in and engage the swivel socket 24. The pawl 26 extends from the swivel socket 24 to the ratchet wheel 46 where it engages cogs 48. A pair of leaf springs 32, 34 are attached to opposite sides respectively of the swivel socket joint 24. Each leaf spring 32, 34 extends forwardly from the socket 24 to a position adjacent the pawl 26. The leaf springs 32, 34 bias the pawl 26 toward the longitudinal center line of the handle 12 to maintain the pawl 26 in engagement with a cog 48 as the push-rod 22 is pushed forwardly while yielding sufficiently to allow the pawl 26 to follow the curvature of the peripheral surface of the ratchet wheel 46. Rigid guides 36, 38 on opposite sides of the push-rod 22 approximately mid-way in the handle 12 maintain the push-rod 22 in proper alignment within the handle 12 and with ratchet wheel 46 as it is reciprocated back and forth.

The rear end of the push-rod 22 extends outwardly through hole 87 in the distal end of the handle 12 and terminates at a knob 30. A coiled compression spring 28 is positioned on the push-rod between the knob 30 and the distal end of the handle 12 to bias the push-rod 28 outwardly. A collar 29 on the push-rod 22 inside the handle limits the extent to which the spring 28 can force the push-rod 22 outwardly. Therefore, the longitudinal force applied on the knob 30 toward the handle results in pushing the push-rod 22 forwardly toward the rotor 40, and when the longitudinal force is released from the knob 30, the spring 28 causes the push-rod 22 to return to the position shown in FIG. 4.

As the push-rod 22 is moved forwardly in the handle 12, the pawl 26 engages a cog 48 on the ratchet wheel 46 and forces the ratchet wheel 46, thus the rotor 40 and the screw-driver ends 41, 42, to rotate in the direction indicated by the arrow 41 in FIGS. 1 and 4. As the spring 28 forces the push-rod 22 longitudinally away from the ratchet wheel 46, the pawl 26 is drawn backwardly along the ratchet wheel 46, and the leaf spring 34 biases the pawl 26 toward center to a position where it can engage the next ensuing cog 48 on the ratchet wheel 46 so that it is poised to begin another cycle. In this manner, the screw-driver tools 41, 42 can be rotated to drive a screw by simple reciprocating motion of the push-rod 22 while the handle 12 is held stationary.

Figure 5:
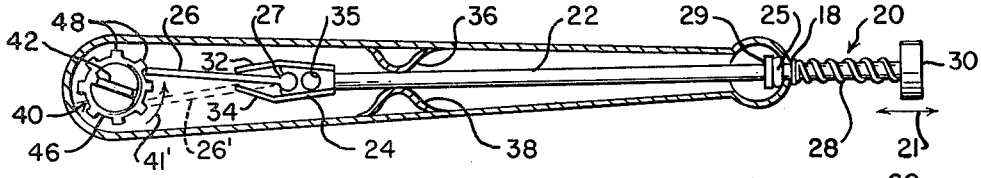
FIG. 5 is a cross-sectional view of the ratchet screw-driver of the present invention taken along the same lines 4—4 of FIG. 3, but with the ratchet drive mechanism positioned to drive the screw-driver in a reverse direction.

The pawl 26 is of an appropriate length so that a reverse twist of the rotor 40 will cause a cog 48 on the ratchet wheel 46 to engage the end of the pawl 26 and move it to a position on the opposite side of the center line of the handle 12 as shown in FIG. 5. The resilient spacer 25 between the inside collar 29 and the end of the handle 12 allows the push-rod 22 and pawl 26 to be forced rearwardly a sufficient distance so that the forward end of the pawl 26 can clear the peripheral surface of the ratchet wheel 46 to be moved to the opposite side. Of course, any other structure, such as a small compression spring or the like that allows a small increment of additional rearward movement for the purpose would suffice. The original position of the pawl 26 is shown in broken lines at 26' for comparison. With the pawl 26 in the alternate position shown in FIG. 5, reciprocating motion of the push-rod 22 will rotate the rotor 40 in the reverse direction as indicated by arrow 41'. In this reverse mode, the leaf spring 32 on the swivel socket 24 engages the pawl 26 and biases it toward the center line to continually re-engage the next succeeding cog 48 as the push-rod 22 is moved away from the rotor 40 in the outward portion of the reciprocating motion. Therefore, a slight twist on the rotor is effective to reverse the ratchet drive mechanism.

The latch pin 31 can be used to retain the push rod 22 and pawl 26 in a forward position against the bias of spring 28. In this forward position, the ratchet mechanism is effective to drive the rotor 40 in response to swinging the handle 12 about the axis of the rotor 12. Therefore, this feature allows the screw driver 10 to be driven by reciprocating the push rod 22 or, alternatively, by swinging the handle 12, as desired by the operator. The former method of operation is useful for quickly screwing a loose screw with a minimum of manual motion, and the latter method is more useful for loosening or tightening screws where space for swinging the handle 12 permits. The latch pin 31 is mounted on a resilient lever attached to the top of the handle 12. A hole 19 in the handle 12 allows the latch pin 31 to be depressed into the interior of the handle 12 and into a hole 35 in swivel socket 24. The latch pin 31 and hole 35 are aligned when the push rod 22 is in a forward position so that the pawl 26 is engaged with ratchet wheel 46. Therefore, insertion of the latch pin 31 into hole 35 retains pawls 26 in that forward position where it cannot be moved to the opposite side of the ratchet wheel 46. As such, it is effective to drive the ratchet wheel 46 to turn the rotor 40 with the handle 12 as the handle 12 is swung in one angular direction about the rotor axis and to leave the rotor 40 stationary as the handle 12 is swung in the opposite direction. Of course, the direction of driving the rotor 40 can be reversed by the same reversal technique described above, i.e., twisting the rotor 40 to move the pawl 26 to the opposite side of the ratchet wheel 46, before the latch pin is engaged with the socket 24.

Figure 6:
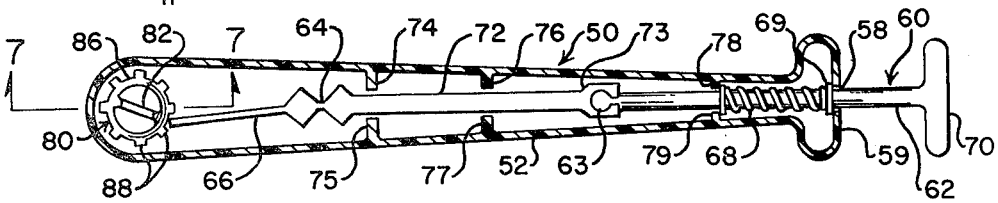
FIG. 6 is a cross-sectional view of an alternative embodiment of the ratchet screw-driver of the present invention particularly suitable for manufacture with non-electrically conductive plastic materials.

An alternative embodiment that is particularly suited for manufacture of the ratchet screw driver 50 and all its component parts of non-electrically conductive plastic material is shown in FIG. 6. This alternative embodiment ratchet screw driver 50 is similar in configuration and function to the embodiment discussed above. It includes an elongated hollow handle 52 comprised of an upper portion 54 and a lower portion 55 attached together to enclose the actuator mechanism 60. The push rod 62 has a ball connector 63 on its interior or forward end, and a knob 70 is formed on its exterior or rearward end. A center extension 72 of the push rod has a socket end 73 adapted to connect with the ball connector 63. The pawl 66 is connected to the center extension 72 by a living plastic hinge 64. The living hinge 64 is a narrow section of flexible plastic material that has sufficient memory to bias the pawl 66 toward the center line of the handle 52. A coil spring 68 is positioned on the push-rod 62 just inside the rear or distal end of the handle 52 for biasing the push-rod 62 outwardly. The interior partitions 74, 75, 76, 77, 78, and 79 provide the dual purposes of re-enforcing the handle 52 and of maintaining the push-rod 62 and center push-rod extension 72 in proper alignment in the center of the handle 52.

Figure 7:
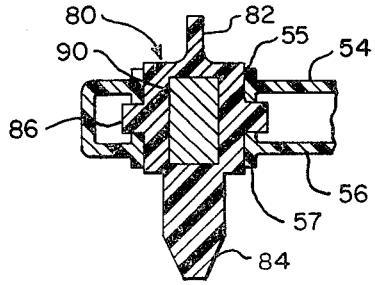
FIG. 7 is an enlarged cross-section view of the rotor and screw-driver shank of the alternate embodiment of the present invention taken along lines 7—7 of FIG. 6.

As best seen in FIGS. 6 and 7, a plastic rotor 80 has a ratchet wheel 86 around its mid-section. A plurality of cogs 88 are distributed around the peripheral surface of the ratchet wheel 86. A conventional screw-driver shape 82 extends axially outward from one end of the rotor 80, and a Phillips screw-driver shape 84 extends axially out the opposite end of the rotor 80, similar to the preferred embodiment described above. Therefore, when the knob 70 is pushed inwardly, the pawl 66 engages a cog 88 on the ratchet wheel 86 and rotates the rotor 80 and screw-drivers 82, 84. The direction of rotation can be reversed by twisting the rotor to move the pawl 66 to the opposite side of the ratchet wheel as described in the preferred embodiment above. It is preferred that the end walls 59 of handle 52 have a slight flexibility and memory to allow the pawl 66 to be moved to the opposite side of the ratchet wheel 86. A collar 69 around the rear portion of the push-rod 62 is rigidly attached to the push-rod 62 and bears against end wall 59, and the spring 68 bears against the collar 69 to bias the push-rod 62 outwardly.

Figure 8:
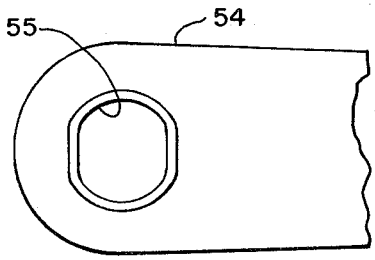
FIG. 8 is an enlarged top plan view of the forward end of the alternate embodiment screw-driver casing without the rotor assembled therein.

As shown in FIGS. 7 and 8, the upper portion 54 of the handle 52 is provided with an annular rim 55. The lower portion 56 of the handle is also provided with a similar annular rim 57 in axial alignment with the annular rim 55. The rotor 80 is positioned in the annular rims 55, 57, and, when assembled, the annular rims 55, 57 bear against the rotor 80 and the ratchet wheel 86 to maintain the rotor 80 in alignment. As also shown in FIG. 8, it is preferred that the annular rims 55, 57 be formed slightly out of round or with a slight flat portion in order to create a binding effect between the rims 55, 57 and the rotor 80. This slight binding produces a braking effect to prevent the rotor 80 from being turned in a reverse direction as the pawl 66 is dragged backwardly thereacross during rearward movement of the push-rod 62.

Also shown in FIG. 7, a magnetic insert 90 can be embedded in the rotor 80 to magnetically retain a screw in contact with the screw-driver ends 82, 84.

While the present invention has been described with some degree of particularity, it should be appreciated that the present invention is defined by the following claims construed in light of the prior art so that modifications or changes may be made to the preferred embodiment of the present invention without departing from the inventive concepts contained herein.

What I claim is:

1. Screw-driver apparatus, comprising:

tool means adapted for engaging a screw to transmit angular motion to the screw;

rotor means connected to said tool means for imparting angular motion to said tool means; and a ratchet wheel on said rotor having a plurality of cogs on its peripheral surface in spaced-apart relation to each other, a push rod positioned with its longitudinal axis perpendicular to the axis of said rotor, and a pawl attached to one end of said push rod and extending into engagement with said ratchet wheel, said push rod being movable longitudinally in a linearly reciprocating manner and biased in a direction away from said ratchet wheel, and said pawl being pivotally attached to said one end of said push rod and extending to engage cogs on one side of said ratchet wheel to rotate said rotor in one angular direction as said push rod is moved in a linearly reciprocating manner, and wherein said pawl is movable to an alternate position extending from the push rod to engage cogs on the opposite side of said ratchet wheel to rotate said rotor in the opposite angular direction as the push rod is moved in the linearly reciprocating manner.

2. The screw-driver apparatus of claim 1, wherein said pawl is of an appropriate length such that it cannot clear the cogs on the peripheral surface of said ratchet wheel to shift from one side of said ratchet wheel to the other when the ratchet wheel remains motionless.

3. The screw-driver apparatus of claim 2, wherein said pawl is biased toward alignment with the longitudinal axis of said push rod and normal to the axis of said ratchet wheel.

4. The screw-driver apparatus of claim 3, including an open ended socket connector mounted on the forward end of said push rod and a cylindrical member on the rear end of said pawl, said cylindrical member being positioned pivotally in said socket connector.

5. The screw-driver apparatus of claim 4, including a pair of leaf springs mounted on opposite sides of said socket and extending forwardly along opposite sides of said pawl to bias said pawl toward alignment with the longitudinal axis of said push rod.

6. The screw-driver apparatus of claim 3, said pawl is conneced to the forward end of said push rod by a flexible member having sufficient internal memory to bias said pawl toward alignment with the longitudinal axis of said push rod.

* * * * *